US008123031B2

(12) United States Patent
Vax

(10) Patent No.: US 8,123,031 B2
(45) Date of Patent: Feb. 28, 2012

(54) HANG TAG SYSTEM

(75) Inventor: Joe Vax, Oakland, CA (US)

(73) Assignee: Protective Industrial Products, Inc., Albany, NY (US)

( * ) Notice: Subject to any disclaimer, the term of this patent is extended or adjusted under 35 U.S.C. 154(b) by 709 days.

(21) Appl. No.: 12/192,040

(22) Filed: Aug. 14, 2008

(65) Prior Publication Data

US 2009/0045085 A1 Feb. 19, 2009

Related U.S. Application Data

(60) Provisional application No. 60/955,853, filed on Aug. 14, 2007.

(51) Int. Cl.
*B65D 73/00* (2006.01)
*B65D 85/18* (2006.01)

(52) U.S. Cl. ..... 206/296; 206/495; 40/673

(58) Field of Classification Search ..... 206/278, 206/296–298, 349.495; 40/661.04, 673
See application file for complete search history.

(56) References Cited

U.S. PATENT DOCUMENTS

| | | | | | |
|---|---|---|---|---|---|
| 949,201 | A | * | 2/1910 | Shaw | 40/636 |
| 1,439,106 | A | * | 12/1922 | Horn | 248/690 |
| 1,862,518 | A | * | 6/1932 | Alland | 206/259 |
| 1,885,503 | A | * | 11/1932 | Acton | 223/93 |
| 2,663,877 | A | * | 12/1953 | Bohman | 2/239 |
| 2,710,409 | A | | 6/1955 | Burandt | |
| 4,485,917 | A | | 12/1984 | Smith | |
| 4,650,074 | A | | 3/1987 | Vosbikian | |
| 4,848,571 | A | | 7/1989 | Fullar | |
| 5,193,676 | A | | 3/1993 | Gold | |
| 5,197,596 | A | * | 3/1993 | Garganese | 206/6.1 |
| 5,261,580 | A | | 11/1993 | Smith | |
| 5,505,351 | A | | 4/1996 | Najarian | |
| 5,553,706 | A | | 9/1996 | Gold | |
| 5,988,373 | A | | 11/1999 | Yates | |
| 6,032,294 | A | * | 3/2000 | Dean | 2/239 |
| 6,178,681 | B1 | | 1/2001 | Caloia et al. | |
| 6,374,420 | B2 | * | 4/2002 | Jossi | 2/239 |
| 6,375,005 | B1 | | 4/2002 | McCann | |
| 6,488,147 | B2 | * | 12/2002 | Mattesky | 206/278 |
| 6,547,073 | B1 | | 4/2003 | Lee | |
| 6,817,497 | B2 | | 11/2004 | Grasso | |
| 6,883,664 | B2 | | 4/2005 | Lee | |
| 2005/0035013 | A1 | | 2/2005 | Bates et al. | |
| 2006/0118449 | A1 | | 6/2006 | Samberg | |
| 2007/0007154 | A1 | | 1/2007 | Wu | |
| 2007/0045131 | A1 | * | 3/2007 | Kim | 206/6.1 |

* cited by examiner

*Primary Examiner* — Sue Weaver
(74) *Attorney, Agent, or Firm* — Brian Beverly; Beeson Skinner Beverly, LLP

(57) ABSTRACT

An improved merchandise display system comprises a display tag, one or more product flaps each for attachment to an item of merchandise, and a detachable fastener. The fastener comprises a screw and a nut, the screw having a post for threaded engagement with the nut. The head of the screw, and the nut, are wider than the aperture and the post is received in the aperture in the display tag. The product flap is detachably held between the nut and the front surface of the display tag with the post of the screw received in an opening in the flap such that the product may be removed from and reattached to the display tag by disassembling and reassembling the display tag, fastener and product flap. A second product flap may be detachably held between the screw head and the back surface of the display tag.

13 Claims, 3 Drawing Sheets

HANG TAG SYSTEM

CROSS REFERENCE TO RELATED APPLICATION

This application claims the benefit of U.S. Provisional Application No. 60/955,853 filed Aug. 14, 2007.

FIELD OF THE INVENTION

This invention relates to an improved merchandise display tag system, and more particularly, to a merchandise display tag system by which merchandise, such as a pair of gloves, can be removably attached to a hanging display tag.

BACKGROUND

Merchandise display tags are a well known device for hanging articles of merchandise from display racks and many ways have been developed to attach merchandise to display tags including, for example, adhesives, straps, tags, chains, bindings, staples, pins, clasps, clips and screws. A display tag not only holds the item of merchandise being displayed but generally presents useful information to a consumer about the product. Sometimes, however, display tags can unduly interfere with close examination or inspection of the merchandise. For example, display tags are commonly attached to a pair of gloves, like many articles of clothing, with plastic T-barb or loop fasteners that must pass through a portion of the glove material. This has two disadvantages. First, many gloves are constructed using a combination of elastic material and a rugged, wear-resistant material, e.g., leather, suede, or a durable nonwoven polymer. Passing the fastener through the rugged material creates an unwanted permanent hole. Second, since elastic materials are generally comprised of a mesh of woven fibers, each of which fibers is relatively weak, passing or pushing the fastener through the elastic material when initially attaching the fastener can result in damage to the material. In addition, normal handling of the glove by consumers and retail personnel can result in the fastener tearing out of and damaging the material. In particular, this may happen when a customer tries on a glove. Doing so can cause the loop or T-barb fastener to catch when pulled, resulting in stress on the material and unintended damage to the product. There is, therefore, a need for a display tag system that does not damage the goods when being attached, and that reduces or avoids entirely damage to the goods from handling while the product is being merchandised. Particularly, with respect to gloves, there is a need for a display tag system that facilitates a consumer trying on a displayed glove without interference from attached the display tag. In some circumstances it may be beneficial to be able to remove merchandise temporarily from a display tag in order to reduce consumer frustration and improve the shopping experience.

Commonly, display tags are attached to merchandise in such a way that the tag or a connecting element of the tag must be destroyed to separate the tag from the merchandise. Thus, if after detaching the tag from the merchandise the consumer chooses not to purchase the merchandise, or if the display tag accidentally becomes separated from the merchandise, the display tag may be reattached only with makeshift methods. Merchandise without an originally attached display tag may not meet consumer expectations for new and undamaged goods and, therefore, can be more difficult to sell. A substantial amount of time is spent by retail personnel reattaching removed display tags to merchandise and redisplaying the merchandise, all at considerable cost and frustration to the retailer.

It is beneficial to present an orderly display of goods and still be able to detach and reattach an item of interest from its display tag, especially when many items of merchandise are crowded into limited space on a display rack. Limiting the twisting and swinging movement of displayed merchandise helps to maintain order and organization on the display rack and prevents merchandise and display tags from becoming separated.

Accordingly, when a customer will be directly examining merchandise on display, there is a need for a reattachable merchandise display tag, especially one which avoids collateral damage to the merchandise incurred from attaching the display tag. A further need exists for a display tag system that limits twisting and swinging movement of items of merchandise hung from display tags.

DETAILED DESCRIPTION OF THE ILLUSTRATED EMBODIMENT

Figure 1:
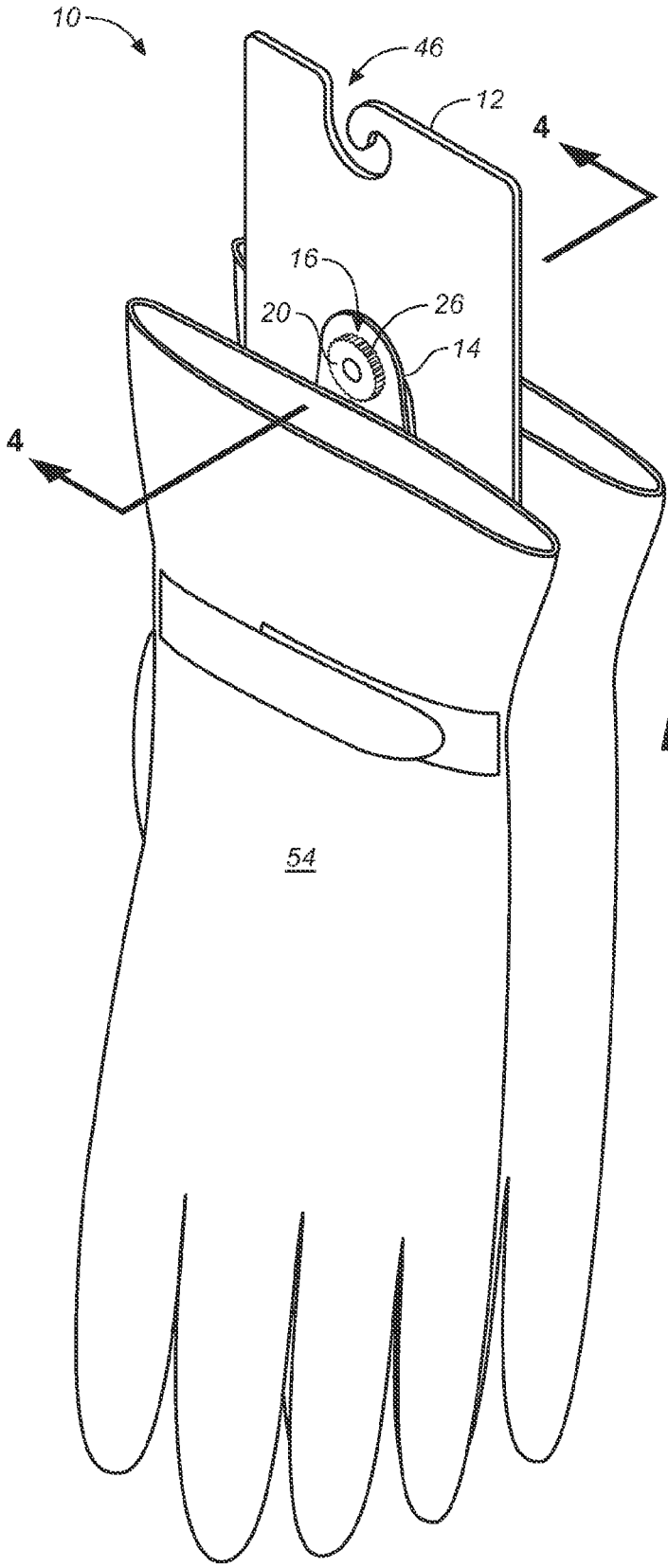
FIG. 1 is a perspective view of a hang tag system according to the present invention.
Figure 2:
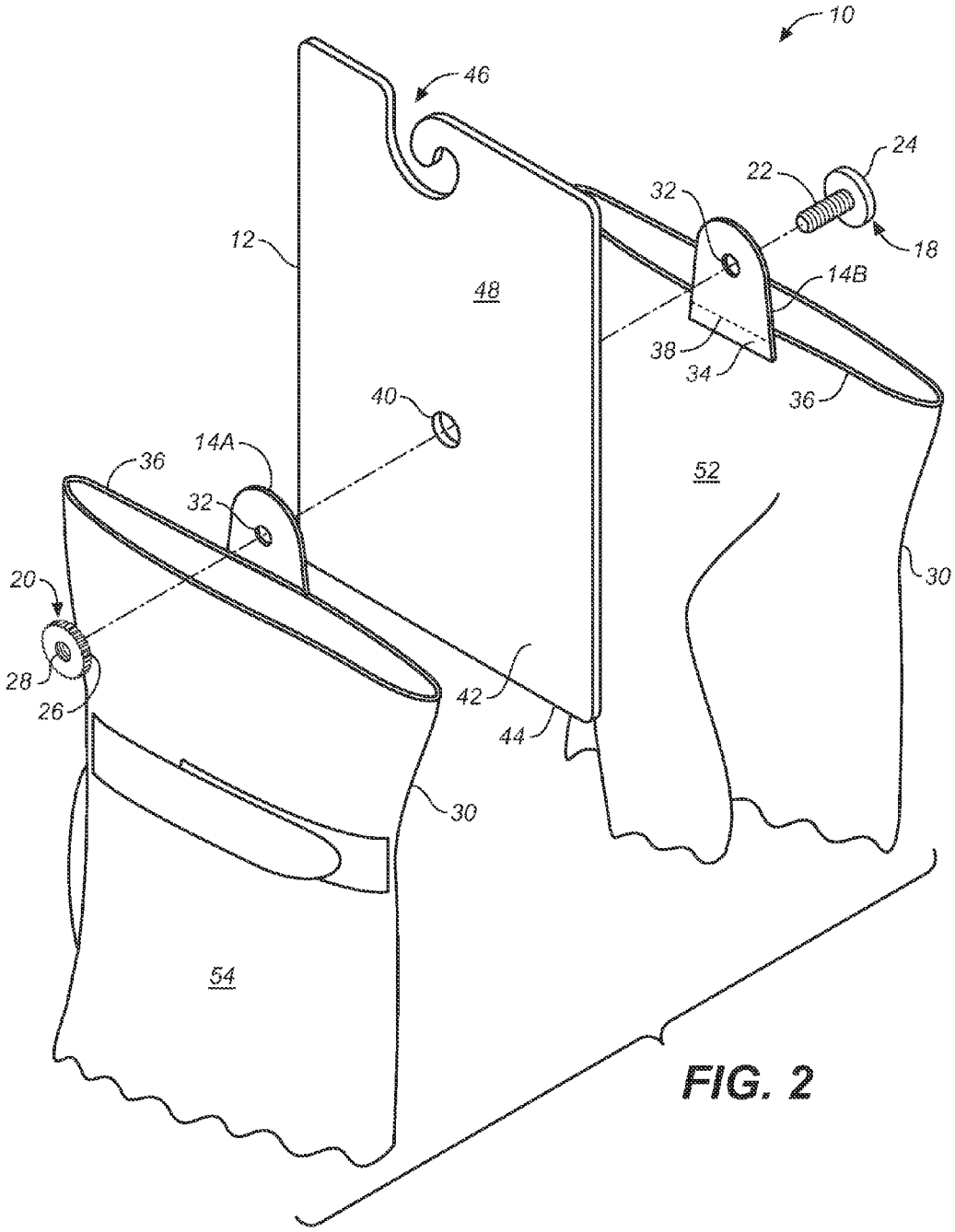
FIG. 2 is an exploded perspective view of the hang tag system shown in FIG. 1.

An improved merchandise display tag system 10 comprising a display card or tag 12, flap 14 and fastener 16, is generally indicated in FIG. 1. The fastener 16 is used to removably attach the flap 14 to the display tag 12. Referring to FIG. 2, the fastener 16 includes a screw 18 and a nut 20, both of which may be constructed from a wide range of materials including various metals and plastics. The screw 18 comprises a cylindrical threaded post 22 and a substantially flat head 24.

The nut 20 is substantially planar, preferably having a generally circular shape. A knurled outer surface 26 of the nut 20 serves as a gripping surface for holding and turning the nut 20 about the threaded post 22. A threaded hole 28 in the nut 20 is sized for mating engagement with the threaded post 22 of the screw 18. In one embodiment not illustrated, the nut 20 is shaped as a cap which, when engaged with the screw 18, covers the distal end surface of the post 22.

According to the invention, the flap 14 may be attached to virtually any article of merchandise to be displayed from a display tag. In the illustrated embodiment, an attachment flap 14 is attached to each one of a pair of gloves 30. Each flap 14 has an opening 32 sized to receive the post 22 of the screw 18. A lower attachment edge 34 of the flap 14 is attached to the anterior portion of the glove's hand opening edge 36. While it is possible to attach the flap 14 to any part of the glove 30, it is generally preferable to attach it to that portion of the glove constructed of the more durable materials discussed above, rather than to portions of the glove made from elastic materials. It should be noted that some styles of gloves have a band or cuff of elastic material extending away from the hand opening edge 36 for hugging the wrist. In those glove styles, which are not here illustrated, it is preferable to attach the flap 14 to the more durable material, such as at the edge of the durable material surrounding the wrist immediately adjacent the elastic cuff, to provide a more secure attachment of the display tag 12 to the glove 30. However, it is intended that this invention embrace attachment of the flap 14 anywhere on the glove 30 or other item of merchandise.

In the illustrated embodiment, the flap 14 is sewn to the glove 30 at seam 38. As will be readily appreciated, the flap 14 may be attached to the glove 30 by numerous other means familiar to those skilled in the art. In the illustrated embodiment, the shape of the flap 14 is substantially elliptical, but it will be understood that the flap 14 may be constructed of any suitable material in any size and shape appropriate for use with a particular item of merchandise and the display tag 12. It may be particularly desirable to construct the flap with the same material used in the construction of the merchandise for maximum integration of the flap with the merchandise.

The tag 12 includes an aperture 40 sized to receive the post 22. The head 24 and nut 20 each have a diameter larger than the aperture 40. In the illustrated embodiment, the aperture 40 is located in the middle of the tag 12 such that a substantial bottom portion 42 of the tag 12 extends below the aperture 40 to the bottom edge 44 of the tag 12. In the embodiment shown in FIGS. 1 and 2, the top of the tag 12 has a hook shaped opening 46 which serves as a hanging part or portion from which to hang the tag 12. It will be readily understood that numerous other configurations and parts may serve as a hanging portion including clips, clamps, pins, hooks, clasps, latches and links. The display tag 12 may be made in any desired shape and size and of any suitable material such as metal, plastic, paper and, frequently, paperboard which has favorable lightness and rigidity characteristics.

Figure 3:
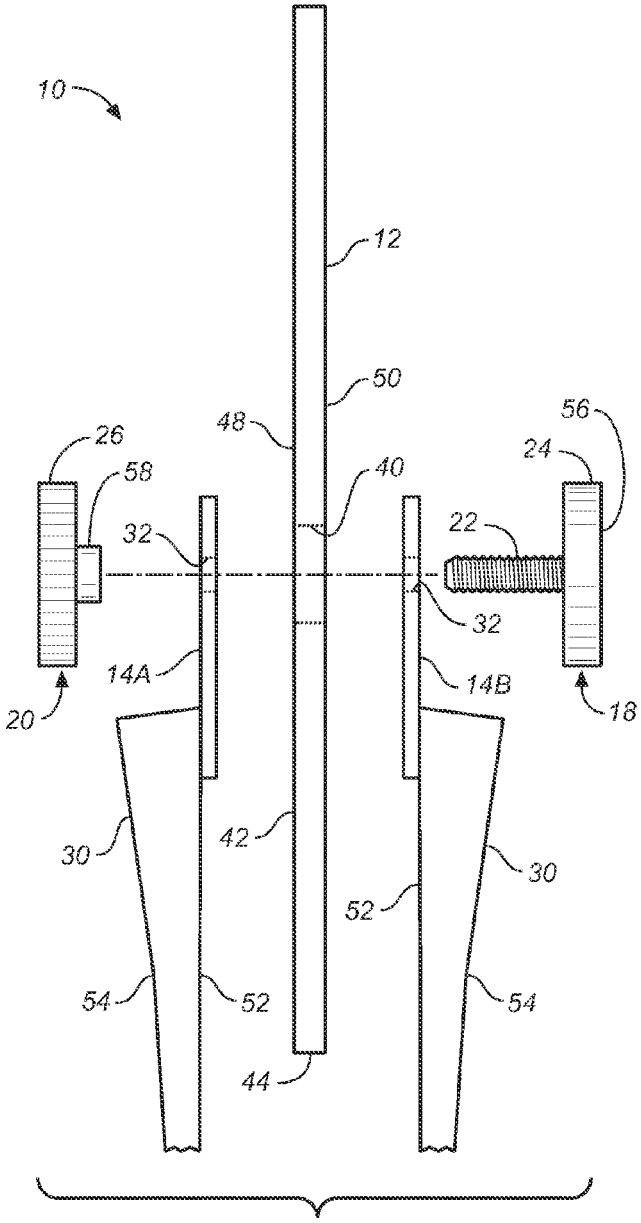
FIG. 3 is an exploded side elevation view of the hang tag system shown in FIG. 1.
Figure 4:
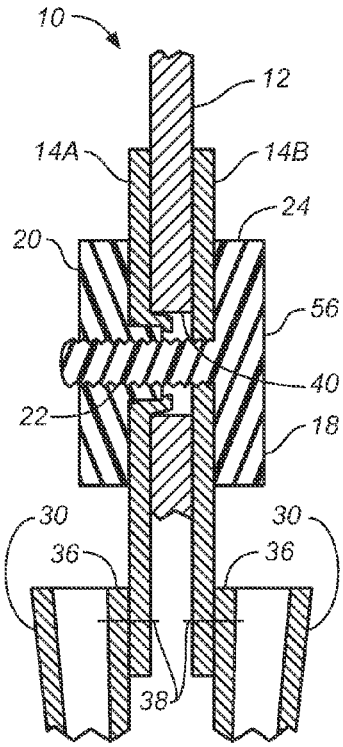
FIG. 4 is an enlarged cross-sectional view of the hang tag system taken along line 4-4 as shown in FIG. 1.

Referring to FIGS. 2-4, the components of the hang tag system 10 are disposed so that each of the flaps 14A, 14B lays flat against the one of the surfaces 48, 50 of the tag 12, with the flap opening 32 of each flap aligned with aperture 40. When fully assembled the post 22 of the fastener 16 extends through the flap opening 32 of each flap 14A, 14B and the tag aperture 40, and the nut 20 is fastened onto screw 18, thereby capturing flaps 14A and 14B in the gaps between the tag 12 and the head 24 and the tag 12 and nut 20, respectively. In this configuration, the bottom portion 42 of the tag 12 extends substantially below the aperture 40 and is interposed between the pair of gloves 30 providing thereby a rigid lateral backing for the upper parts of the adjacent gloves 30 and minimizing any twisting and swinging movement of the gloves 30.

In the illustrated embodiment a first flap 14A is adjacent to the front surface 48 of tag 12 and a second flap 14B is adjacent to the back surface 50 of tag 12. Since each tag 12 is attached to the anterior portion of the hand opening edge 36, the anterior sides 52 of the gloves are brought into facing relation and the posterior sides 54 of the gloves, which generally carry more aesthetic interest, are presented outwardly for display. This arrangement has the additional advantages that it forces the gloves 30 to lay flat against the tag 12 for an orderly presentation, and that the bottom portion 42 of the tag 12 minimizes any potential swinging or flapping motion of the gloves 30 relative to the tag 12. Furthermore, the flap 14, rather than the glove 30, tends to absorb any damage which may be caused by the fastener 16, thereby preserving the glove. This is because only the flap 14, not the glove 30, is in contact with the fastener 16. Moreover, since the fastener 16 attaches to the flap 14, not the glove 30, there is no need to make a hole in the glove 30 to attach the tag 12.

The hang tag system 10 may be quickly assembled at a manufacturing facility by aligning the opening 32 of each flap 14 with the aperture 40 of the tag 12 as shown in FIG. 2. The post 22 is inserted through the flap openings 40 and tag aperture 40. If the screw 18 or nut 20 are fabricated from a suitably flexible material, the nut 20 may be pressed over the threaded post 22 of the screw 18 for a secure snap-fit attachment. In the illustrated embodiment the flat head 24 of screw 18 provides a pressable surface 56 disposed perpendicular to the post 22 which facilitates finger-tip snap-fitting of the screw 18 into the nut 20. As seen in FIG. 4, the post 22 is short enough that it does not interfere with press-fitting of the nut 20 onto the screw 18. Inwardly projecting annular ridge 58 on nut 20 has a diameter smaller than aperture 40 of tag 12. Ridge 58 constrains movement of the nut 20 and screw 18 in aperture 40 and will compress portions of flap 14 immediately adjacent post 22 into aperture 40 when screw 18 and nut 20 are fully tightened, holding product firmly on the tag 12.

The hang tag system 10 may be disassembled by gripping the knurled outer surface 26 of the nut 20 and unscrewing it from the threaded post 22. By completely removing the nut 20 from the post 22, the flaps 14 and the tag 12 may be separated from each other and the post 22. Consequently, the merchandise attached to the flaps 14 may be fully removed from the display tag 12, or vice versa, without destroying the fastener, such that the merchandise is fully accessible for inspection and trial use by a customer. Placement of the flaps 14 on the anterior side of the hand opening edge 36 of the gloves 30 also has the advantage that access by a consumer to the hand opening is completely unrestricted. Moreover, since the flap is flexible, the body of the glove can pull away from the display tag just enough that a customer may try on one or the other of the gloves 30 with no interference from the display tag or fastener.

Another advantage of the present hang tag system 10 is that the tag 12, flaps 14, and fastener 16 are all reusable after disassembly. Thus, separation of a display tag from merchandise need not be irreparable because the hang tag system 10 is capable of being quickly and easily restored to its original configuration.

While preferred embodiments of the present invention have been described and disclosed, it will be recognized by those with skill in the art that modifications are within the true spirit and scope of the invention.

I claim:

1. A merchandise display tag system comprising:

a substantially rigid planar display tag having a front surface, an aperture, and a hanging portion for hanging said display tag on a merchandise display rack, a detachable fastener including a screw and a nut, said screw having a head and a threaded post, said post being freely received in said aperture, said nut having a threaded hole, an inner face, an annular perimeter edge, and an annular ridge, said post threadedly engaged with said hole, said annular perimeter edge having a knurled gripping surface, said annular ridge surrounding said threaded hole and projecting inwardly from said inner face, said annular ridge having a diameter smaller than the aperture of said display tag and being closely received in the aperture of said display tag for centering said nut relative to said aperture, the head of said screw and said nut each having a diameter larger than said aperture, said screw and said nut capable of being disengaged from each other using finger-tip pressure, and one or more articles of merchandise, each article of merchandise having an upwardly extending attachment flap having an opening, the post of said screw removably received in said opening, said attachment flap of at least one of said one or more articles of merchandise detachably held between said nut and said front surface of said display tag, such that by disengaging and re-engaging said screw and said nut said at least one of said one or more articles of merchandise can be removed from and reattached to said display tag without destroying said fastener.

2. The merchandise display tag system of claim 1 wherein:

said post may be threadedly advanced or retracted in said hole manually.

3. The merchandise display tag system of claim 1 wherein:

said screw and said nut are fabricated from a material that is suitably flexible to permit said nut to be manually press-fitted onto the post of said screw to secure said nut to said screw.

4. The merchandise display tag system of claim 1 wherein:

said head of said screw is flat for providing a pressable surface for facilitating press-fitting said post into said hole using fingertip pressure.

5. The merchandise display tag system of claim 1 further comprising:

said one or more articles of merchandise including at least one glove, said glove having a hand opening defined by a hand opening edge, said attachment flap attached to said hand opening edge.

6. The merchandise display tag system of claim 5 wherein:

said at least one glove comprises at least a pair of gloves.

7. The merchandise display tag system of claim 1 further comprising:

said display tag having a back surface opposite said front surface, and said attachment flap of at least a second one of said one or more articles of merchandise is detachably held between the head of said screw and the back surface of said display tag.

8. The merchandise display tag system of claim 1 wherein:

said annular ridge of said nut has a diameter larger than the opening in each of said attachment flaps such that when said screw and said nut are fully engaged said annular ridge catches and compresses portions of said flap immediately surrounding said opening into the aperture of said display tag.

9. The merchandise display tag system of claim 8 wherein:

said display tag includes a back surface opposite said front surface, and said annular ridge has an inner end terminating in said aperture between the front and back surfaces of said display tag.

10. A merchandise display tag system comprising:

a substantially rigid planar display tag having a front surface, a back surface opposite said front surface, an aperture, and a hanging portion for hanging said display tag on a merchandise display rack, a detachable fastener including a screw and a nut, said screw having a head and a threaded post, said post being freely received in said aperture, said nut having a threaded hole, an inner face, an annular perimeter edge, and an annular ridge, said post threadedly engaged with said hole, said annular perimeter edge having a knurled gripping surface, said annular ridge surrounding said threaded hole and projecting inwardly from said inner face, said annular ridge having a diameter smaller than the aperture of said display tag and being closely received in the aperture of said display tag for centering said nut relative to said aperture, the head of said screw and said nut each having a diameter larger than said aperture, said screw and said nut capable of being disengaged from each other using finger-tip pressure, and a pair of gloves, each glove having an upwardly extending attachment flap having an opening, the post of said screw removably received in said opening, the attachment flap of one of said gloves detachably held between said nut and said front surface of said display tag, the attachment flap of the other of said gloves detachably held between the head of said screw and the back surface of said display tag, such that by disengaging and re-engaging said screw and said nut said pair of gloves can be removed from and reattached to said display tag without destroying said fastener.

11. The merchandise display tag system of claim 10 wherein:

each glove has a hand opening defined by a hand opening edge, said hand opening edge having an anterior portion, and said attachment flap is attached to the anterior portion of the hand opening edge of said glove.

12. A merchandise display tag system comprising:

a substantially rigid planar display tag having a front surface, a back surface opposite said front surface, an aperture, and a hanging portion for hanging said display tag on a merchandise display rack, a detachable fastener including a screw and a nut, said screw having a head and a threaded post, said post being freely received in said aperture, said nut having a threaded hole, an inner face, an annular perimeter edge, and an annular ridge, said post threadedly engaged with said hole, said annular perimeter edge having a knurled gripping surface, said annular ridge surrounding said threaded hole and projecting inwardly from said inner face, said annular ridge having a diameter smaller than the aperture of said display tag and being closely received in the aperture of said display tag for centering said nut relative to said aperture, the head of said screw and said nut each having a diameter larger than said aperture, said screw and said nut are fabricated from a material that is suitably flexible to permit said nut to be manually press-fitted onto the post of said screw to secure said nut to said screw, said screw and said nut capable of being disengaged from each other using finger-tip pressure, and a pair of gloves, each glove having an upwardly extending attachment flap having an opening, the post of said screw removably received in said opening, the attachment flap of one of said gloves detachably held between said nut and said front surface of said display tag, the attachment flap of the other of said gloves detachably held between the head of said screw and the back surface of said display tag, the annular ridge of said nut having a diameter larger than the opening in the attachment flap in each of said gloves such that when said screw and said nut are fully engaged said annular ridge catches and compresses portions of said flap immediately surrounding said opening into the aperture of said display tag, such that by disengaging and re-engaging said screw and said nut said pair of gloves can be removed from and reattached to said display tag without destroying said fastener.

13. The merchandise display tag system of claim 12 wherein:

the post of said screw has a length short enough that said post does not interfere with press-fitting of said nut onto said screw.

* * * * *

UNITED STATES PATENT AND TRADEMARK OFFICE

CERTIFICATE OF CORRECTION

PATENT NO. : 8,123,031 B2
APPLICATION NO. : 12/192040
DATED : February 28, 2012
INVENTOR(S) : Joe Vax It is certified that error appears in the above-identified patent and that said Letters Patent is hereby corrected as shown below:

In column 3, line 66, "openings 40" should read --openings 32--.

Signed and Sealed this
Twenty-eighth Day of August, 2012

David J. Kappos

David J. Kappos
*Director of the United States Patent and Trademark Office*